US005983409A

United States Patent [19]

Aldridge et al.

[11] Patent Number: 5,983,409

[45] Date of Patent: Nov. 16, 1999

[54] LIGHTWEIGHT FIREFIGHTER GARMENT

[75] Inventors: Donald Aldridge, New Carlisle; Nicholas J. Curtis, Dayton, both of Ohio

[73] Assignee: Lion Apparel, Inc., Dayton, Ohio

[21] Appl. No.: 09/274,626

[22] Filed: Mar. 23, 1999

Related U.S. Application Data

[63] Continuation-in-part of application No. 09/015,184, Jan. 29, 1998.

[51] Int. Cl.[6] ..... A62B 17/00; A62D 5/00

[52] U.S. Cl. ..... 2/458; 2/81; 2/93; 2/82; 2/97

[58] Field of Search ..... 2/81, 82, 85, 87, 2/93, 97, 457, 458

[56] References Cited

U.S. PATENT DOCUMENTS

| | | | |
|---|---|---|---|
| Re. 35,436 | 2/1997 | Grilliot et al. | 2/293 |
| 4,034,417 | 7/1977 | Ellis | 2/81 |
| 4,502,153 | 3/1985 | Lapedes et al. | 2/81 |
| 4,843,646 | 7/1989 | Grilliot et al. | 2/69 |
| 5,007,112 | 4/1991 | Lewis, Jr. et al. | 2/79 |
| 5,050,241 | 9/1991 | Flowers et al. | 2/81 |
| 5,127,106 | 7/1992 | Aldridge | 2/81 |
| 5,170,506 | 12/1992 | Lewis, Jr. et al. | 2/79 |
| 5,172,426 | 12/1992 | Capello | 2/81 |
| 5,542,124 | 8/1996 | Grilliot et al. | 2/81 |
| 5,614,302 | 3/1997 | Nance, Jr. | 442/286 |
| 5,628,065 | 5/1997 | Austin | 2/81 |
| 5,640,718 | 6/1997 | Aldridge | 2/81 |
| 5,920,905 | 7/1999 | Aldridge | 2/81 |

*Primary Examiner*—John J. Calvert
*Assistant Examiner*—Robert H Muromoto, Jr.
*Attorney, Agent, or Firm*—Thompson Hine & Flory LLP

[57] ABSTRACT

A protective garment, such as a firefighting garment, is provided that is relatively lightweight, possesses relatively high resistance to liquid water absorption, and also possesses high moisture vapor transport characteristics when compared to conventional firefighter garments. The garment of the present invention comprises at least an outer shell, and thermal liner positioned within the outer shell. A discrete moisture barrier layer is not required, but is utilized in certain embodiments. At least the insulating material of the thermal liner is treated with a durable, water repellant finish to reduce the amount of moisture absorbed by the thermal liner. Preferably, the outer shell, and optionally, the fabric substrate of the thermal liner may also be treated with a durable, water repellant finish to minimize liquid transfer therethrough. Thus, the construction of the garment substantially reduces the amount of liquid moisture absorbed by the thermal liner, thereby maintaining insulating properties of the thermal liner and also maintaining desirable lightweight properties of the thermal liner for longer periods. Furthermore, the construction of the garment enhances the transport of moisture vapor therethrough for breathability and enhanced body-cooling. Such durable, water repellant finishes are provided by treating the components with a commercially available perfluorohydrocarbon finish such as TEFLON (a trademark of E.I. DuPont de Nemours & Co., Inc.).

25 Claims, 4 Drawing Sheets

LIGHTWEIGHT FIREFIGHTER GARMENT

CROSS REFERENCE TO RELATED APPLICATIONS

The present application is a continuation-in-part of U.S. patent application, Ser. No. 09/015,184, filed Jan. 29, 1998.

BACKGROUND

The present invention relates to hazardous duty garments and, more particularly, to lightweight firefighter garments which protect a wearer from extreme ambient conditions.

Protective garments are designed to shield a wearer from a variety of environmental hazards, and firefighter garments are representative of such garments. A conventional firefighting ensemble comprises a turnout coat and pant, each of which includes an outer shell, a moisture barrier located within the outer shell, a thermal liner located within the moisture barrier and an innermost face cloth layer. The outer shell typically is constructed of an abrasion-, flame- and heat-resistant material such as a woven aramid material, typically NOMEX or KEVLAR (both are trademarks of E.I. DuPont de Nemours & Co., Inc.) or a polybenzamidazole such a PBI (a trademark of Celanese Corp.) fiber material. The moisture barrier typically includes a semipermeable membrane layer which is moisture vapor permeable but impermeable to liquid moisture, such as CROSSTECH (a trademark of W.L. Gore & Associates, Inc.). The membrane layer is bonded to a substrate of flame- and heat-resistant material, such as an aramid or PBI material.

The thermal liner is typically positioned within the moisture barrier in order to prevent the thermal liner from soaking up liquid moisture flowing through the outer shell from the ambient. The thermal liner typically comprises a layer of insulation material, such as a relatively thick layer of aramid fiber batting or needlepunch, which is often quilted to a lightweight aramid fabric substrate or face cloth. The batting of the thermal barrier traps air and possesses sufficient loft to provide the necessary thermal resistance, and the fabric substrate protects the batting of the thermal liner from abrasion from the wearer.

The aforementioned components typically are arranged within the garment so that the moisture barrier layer is positioned between the thermal liner and the outer shell. This is necessary to prevent the insulating material of the thermal liner from absorbing an excessive amount of liquid moisture from the ambient, which increases the overall weight of the garment and reduces breathability of the thermal liner, thereby increasing the stress imposed by the garment on the wearer, and reduces its loft and thermal resistance characteristics. However, one disadvantage with such an arrangement is that the laminated membrane of the moisture barrier is relatively delicate and can be damaged by heat, abrasion or puncture. Such damage results in increased exposure of the thermal liner to liquid moisture, which increases liquid moisture absorption.

Another disadvantage inherent in such an arrangement is that the moisture barrier layer adds to the bulk and weight of the garment and inhibits freedom of movement of the wearer, producing a "hobbling effect," increasing the stress imposed on the wearer in situations requiring high activity, and accelerates the onset of fatigue. Furthermore, with such an ensemble some perspiration moisture vapor from the wearer is absorbed by the thermal liner. Moreover, the combination of a discrete moisture barrier and thermal liner limits breathability, especially if the thermal liner is positioned within the moisture barrier.

Additionally, many conventional firefighting garments are designed such that their thermal liner, while positioned within the moisture barrier, actually promotes the absorption of fluids, such as a firefighter's perspiration. While such a garment may provide the firefighter short term comfort by keeping the firefighter's skin relatively dry, in the long term, such a thermal liner will tend to lose its insulating characteristics (much like a wet pot-holder) because moisture conducts heat energy better than air.

Accordingly, there is a need for a protective garment in which the susceptibility of the thermal liner to absorption of perspiration moisture and other moisture is minimized; a protective garment which is relatively thin and lightweight, yet provides adequate thermal protection; a protective garment which is inherently able to withstand a temperature of 500° F. for at least five minutes without igniting, melting or dripping, making it suitable for use as a firefighting garment; and a protective garment which minimizes the restriction of movement and hobbling effect characteristic of conventional firefighting garments.

SUMMARY

The present invention provides a protective garment, such as a firefighting garment, that is relatively lightweight, possesses relatively high resistance to liquid absorption, and also possesses high moisture vapor transport characteristics when compared to conventional firefighter garments. The garment of the present invention comprises at least an outer shell, and thermal liner positioned within the outer shell. A discrete moisture barrier layer is not required, but is utilized in certain embodiments of the invention. At least the insulating material of the thermal liner is treated with a durable, water repellant finish to reduce the amount of moisture absorbed by the thermal liner. Preferably, the outer shell, and optionally, the fabric substrate of the thermal liner may also be treated with a durable, water repellant finish to minimize liquid transfer therethrough. Thus, the construction of the garment substantially reduces the amount of liquid moisture absorbed by the thermal liner, thereby maintaining insulating properties of the thermal liner and also maintaining desirable lightweight properties of the thermal liner for longer periods. Furthermore, the construction of the garment enhances the transport of moisture vapor therethrough for breathability and enhanced body-cooling. Such durable, water repellant finishes are provided by treating the components with a commercially available perfluorohydrocarbon finish such as TEFLON (a trademark of E.I. DuPont de Nemours & Co., Inc.) and/or SCOTCHGUARD (a trademark of Minnesota Mining & Manufacturing Co.).

In a first embodiment of the present invention, a firefighting garment consists essentially of an outer shell of abrasion-, flame- and heat-resistant material selected from a group consisting of an aramid material, a blend of aramid materials, PBI material and a blend of aramid and PBI materials; a thermal liner positioned within the outer shell and including a batting, needlepunch or nonwoven aramid material, or a blend of such aramid materials, stitched to a first face cloth layer of aramid material; and a second face cloth layer of aramid material, positioned within the thermal liner; where the material of the outer shell, the thermal liner, and the second face cloth layer are all treated with a durable, water repellant finish.

Such a firefighting garment does not require a discrete moisture barrier layer, yet possesses the necessary thermal protection ratings for use as a firefighting garment. Thus, the firefighting garment is relatively thin and lightweight, thereby minimizing the bulk and reducing the hobbling effect of such a garment. Furthermore, the elimination of a discrete moisture barrier reduces the material costs of the garment. The design of the thermal liner substantially reduces the amount of liquid moisture it absorbs, thereby maintaining the insulative properties of the thermal liner and maintaining desirable lightweight properties for longer periods. Another advantage of such a design is that the transport of moisture vapor through the garment is enhanced.

Alternatively, the orientation of the thermal liner layer may be reversed such that the insulating layer faces the outer shell and the first face cloth layer faces the wearer of the garment. Therefore, in this embodiment, a second face cloth layer is not required.

In an another alternate embodiment of the present invention, a discrete moisture barrier layer is provided, but is positioned between the treated thermal barrier and the inner face cloth. By providing such a moisture barrier, the penetration of blood-borne pathogens from the environment to the wearer is minimized. Furthermore, the positioning of the treated thermal liner between the outer shell and the moisture barrier protects the moisture barrier from damage from excessive thermal heat and from abrasion caused by the outer shell.

In another alternate embodiment, a firefighter garment includes an outer shell, a moisture barrier positioned inside and adjacent to the outer shell, a thermal liner positioned inside of the moisture barrier and an inner face cloth. The thermal liner is treated to have a moisture repellant finish as with the other embodiments. The thermal liner of this embodiment thus will absorb only a minimal amount of perspiration moisture from the wearer, from a breach in the moisture barrier or from openings in the neck and sleeve, and generally will be shielded from ambient moisture by the conventional moisture barrier.

In another alternate embodiment, a firefighting garment includes an outer shell treated with a durable, water-repellant finish; a layer of insulating material attached to a first fabric substrate so as to provide a thermal liner, where the thermal liner is positioned between the outer shell and a wearer of the garment, and where the layer of insulating material is treated with a durable, water-repellant finish; and a substantially liquid-impermeable membrane layer attached to a second fabric substrate so as to provide a moisture barrier layer, the moisture barrier layer being positioned between the outer shell and the thermal liner. It is preferred in such an embodiment that the thermal liner is oriented such that the first fabric substrate faces a wearer of the garment, and thus acts as a face cloth material; and is also preferred that the moisture barrier layer is oriented such that the second fabric substrate faces the outer shell so as to protect the membrane layer from abrasion and damage caused by the outer shell. In such an embodiment, it is also preferred that the outer shell be treated with a durable, water-repellant finish; and further, the first fabric substrate may be optionally treated with a durable, water-repellant finish. In such an embodiment, the water-repellant finish of the thermal liner limits the amount of perspiration absorbed therein, thus allowing the thermal liner to maintain its insulating characteristics for a greater period of time. Furthermore, water-repellant finish of the thermal liner reduces the thermal liner's susceptibility to take on extra water weight, thereby decreasing the stress imposed on the wearer.

In another alternate embodiment, a firefighting garment includes an outer shell treated with a durable, water-repellant finish; a layer of insulating material attached to a first fabric substrate so as to provide a thermal liner, where the thermal liner is positioned between the outer shell and a wearer of the garment, and where the layer of insulating material is treated with a durable, water-repellant finish; and a substantially liquid-impermeable membrane layer to a second fabric substrate so as to provide a moisture barrier layer, the thermal liner being positioned between the outer shell and the moisture barrier layer. It is preferred in such an embodiment that the moisture barrier layer is oriented such that the second fabric substrate faces a wearer of the garment, and thus acts as a face cloth material; and is also preferred that the thermal liner is oriented such that the first fabric substrate faces the outer shell so as to protect the layer of insulating material from abrasions caused by the outer shell. In such an embodiment, it is also preferred that the outer shell and first fabric substrate are treated with a durable, water-repellant finish. In such an embodiment, the water-repellant finish of the thermal liner limits the amount of moisture absorbed therein, thus allowing the thermal liner to maintain its insulating characteristics for a greater period of time.

Accordingly, it is an object of the present invention to provide a protective garment in which the thermal liner absorbs a minimal amount of liquid moisture; a protective garment which reduces the amount of moisture absorbed by the thermal liner; a protective garment which does not require a discrete moisture barrier layer, yet possesses the necessary thermal protection ratings for use as a firefighting garment; a protective garment having a thermal liner which retains its insulating characteristics for a relatively long period of time; a protective garment which is relatively thin and lightweight, thereby minimizing the bulk and reducing the hobbling effect of such a garment and the reducing the material costs of the garment; and a protective garment that enhances the transport of moisture vapor therethrough for breathability and greater cooling.

Other objects and advantages of the present invention will be apparent from the following description, the accompanying drawings and the appended claims.

DETAILED DESCRIPTION

Figure 1:
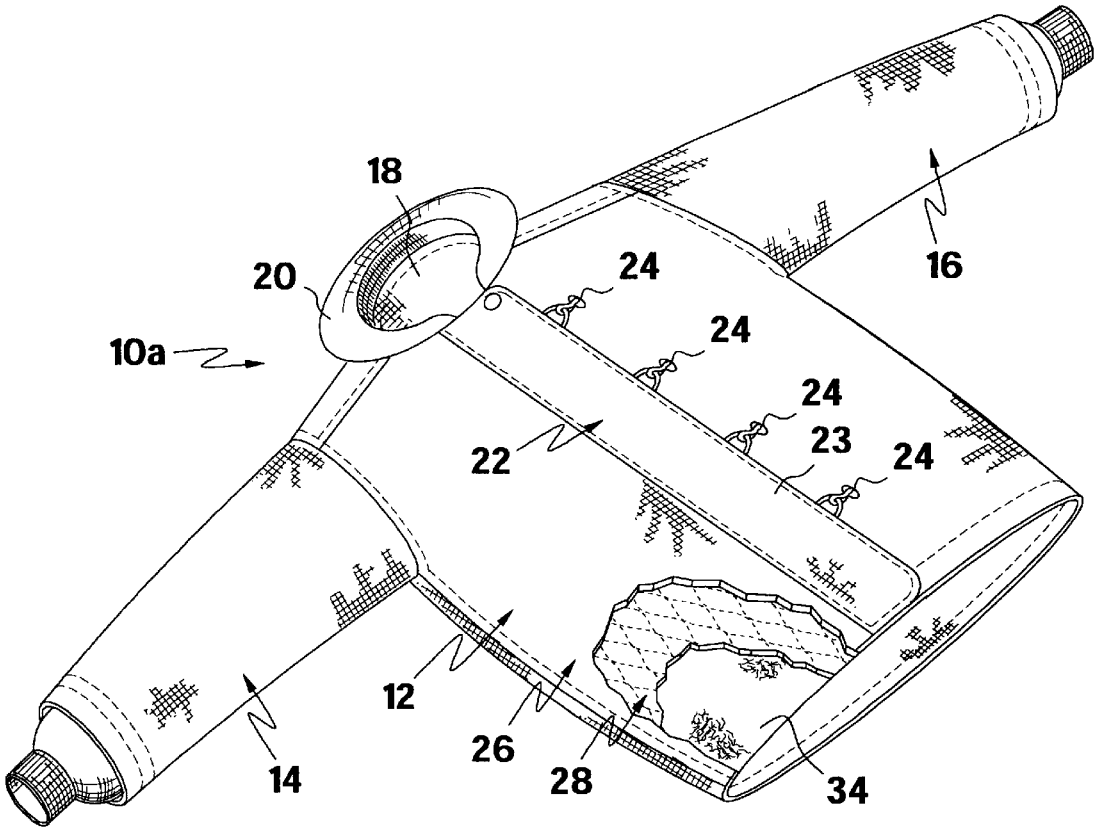
FIG. 1 is a somewhat schematic, perspective view of a firefighter garment incorporating a first embodiment of the present invention.

As shown in FIG. 1, the present invention is a protective garment in the form of a firefighter garment, generally designated 10*a*. It is to be understood that the present invention is not limited to firefighter garments, but can be incorporated in work garments and other hazardous duty garments, such as brushfire and EMS garments, in both coat and pant combinations and "jumpsuit" styles, without departing from the scope of the invention. The garment 10*a* is a firefighter turnout coat having a body portion 12, sleeves 14, 16, a neck opening 18, a collar 20 surrounding the neck opening, and a front closure, generally designated 22. Front closure 22 is of conventional design and includes a storm flap 23. The closure 22 is secured by snaps, or alternatively, strips of hook and loop fastener material (not shown) in combination with mechanical locking means such as hook and "D" combinations 24 extending between the flap 23 and body portion 12, or a slide fastener (not shown).

Figure 2:
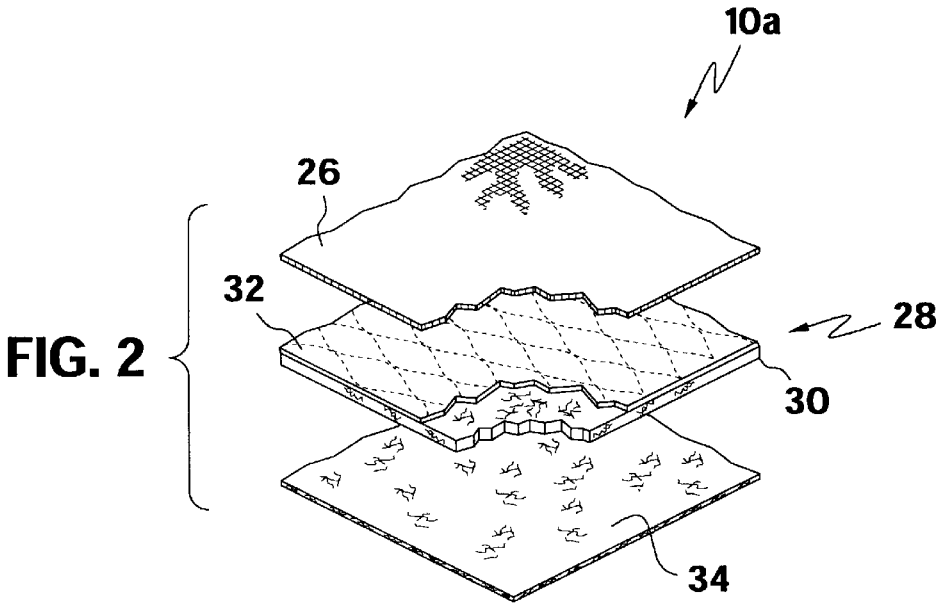
FIG. 2 is an exploded, perspective view of a section of a detail of the garment of FIG. 1.

As shown in FIGS. 1 and 2, the garment 10*a* includes an abrasion, heat and flame resistant outer shell, generally designated 26, which covers substantially the entire outer surface garment. The outer shell is compact weave of an aramid material such as NOMEX or KEVLAR, a blend of such aramid materials, a PBI material, or a blend of aramid and PBI materials. The thermal liner, generally designated 28, extends substantially throughout the garment 10*a* and includes layer 30 of insulating material quilted to a substrate 32 of aramid fabric material. The insulating material can be a batting, needlepunch, or multi-layer nonwoven aramid material. A layer 34 of aramid face cloth material is positioned within the thermal liner 28 and protects the thermal liner from abrasion from the clothing of the wearer. Additionally, it is within the scope of the invention that the foregoing materials may be readily substituted with other materials having similar protective properties, or alternative protective properties corresponding to other specialized hazardous use garments.

The outer shell 26, thermal liner 28 and face cloth layer 34 each are treated with a durable, water-repellant finish prior to assembling these components to form the garment 10*a*. A preferred finish is a perfluorohydrocarbon finish such as TEFLON Fabric Protector. Preferably, a loading of at least 2.5% on weight of fabric of TEFLON is used. A commercially available method for finishing the above components with TEFLON Fabric Protector is provided by E.I. DuPont de Nemours & Co., Inc. of Wilmington, Del., 19898.

It is within the scope of the invention that other suitable water repellant finishes, coatings or treatments may also be used, such as treating the components with a perfluorohydrocarbon finish such as SCOTCHGUARD, or by applying a silicon, resin, wax or plastic finish. In the preferred embodiment of the invention, each component of the garment 10 possesses certain characteristics which makes it particularly suitable for use in a hazardous duty garment, particularly a firefighter garment. The ensemble of the outer shell 26, thermal liner 28 and face cloth layer 34, each treated with a durable, water-repellant finish according to the invention, meets certain requirements of the N.F.P.A. (National Fire Protection Association) 1971 Standard. Specifically, the ensemble resists igniting, melting or dripping when exposed to 500° F. for at least five minutes. Furthermore, the water-repellant finishes applied to the components of the ensemble are durable in that they withstand at least 25 launderings without appreciable diminution in water repellancy. However, a durability of withstanding at least 5 launderings without appreciable diminution in water repellancy is within the scope of the invention.

Consequently, the firefighting garment 10*a* does not require a discrete moisture barrier because the water-repellant finish of the outer shell 26 and face cloth layer 34 substantially prevent liquid moisture from reaching and being absorbed by the thermal liner 28. Furthermore, because the thermal liner 28 is also preferably treated with a water-repellant finish, it will be much less susceptible to absorbing and retaining liquid moisture that penetrates through the outer shell 26, face cloth layer 34, or enters through a seam or opening. Additionally, by eliminating a discrete moisture barrier component, the breathability of the garment is increased, and the weight and "hobbling" effect of the garment is substantially decreased.

It is also within the scope of the present invention to use a thermal liner that includes an insulating layer of apertured, closed-cell foam as described in co-pending U.S. Ser. No. 08/596,702 filed Feb. 5, 1996 or U.S. Ser. No. 08/857,092 filed May 15, 1997, the disclosures of which are incorporated herein by reference. Such thermal liners do not absorb significant amounts of liquid moisture and can be made thinner than conventional thermal liners, yet still meet the overall thermal requirements for firefighting garments.

Figure 7:
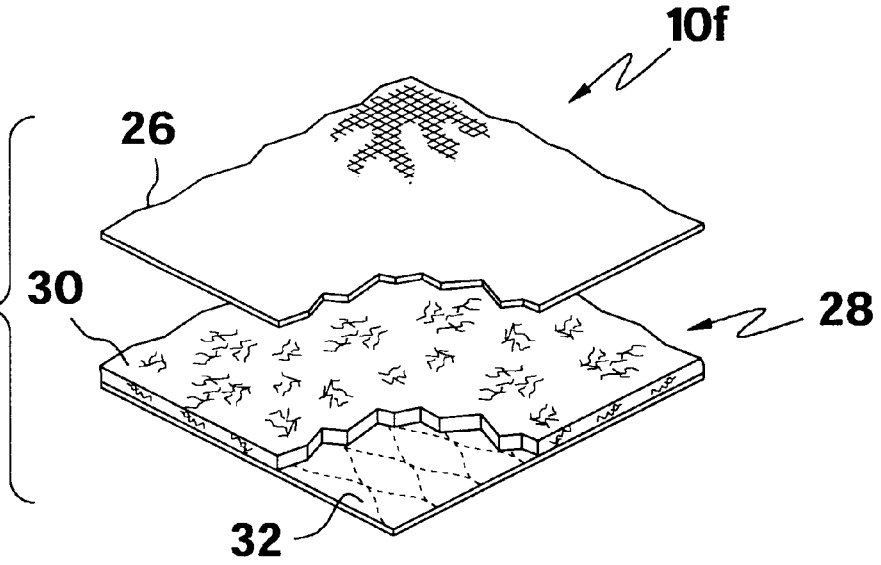
FIG. 7 is an exploded, perspective view of a detail of another alternate embodiment of the invention.

As shown in FIG. 7, in an alternate embodiment 10*f*, the orientation of the thermal liner 28 may be reversed so that the fabric substrate 32 faces the wearer of the garment and thus acts as a face cloth layer, eliminating the need for the face cloth 34. However, it may be desirable to position a layer of aramid fabric material (not shown) between the outer shell 26 and the layer of insulating material 30 to protect the layer of insulating material from damage induced by contact with the outer shell.

Figure 3:
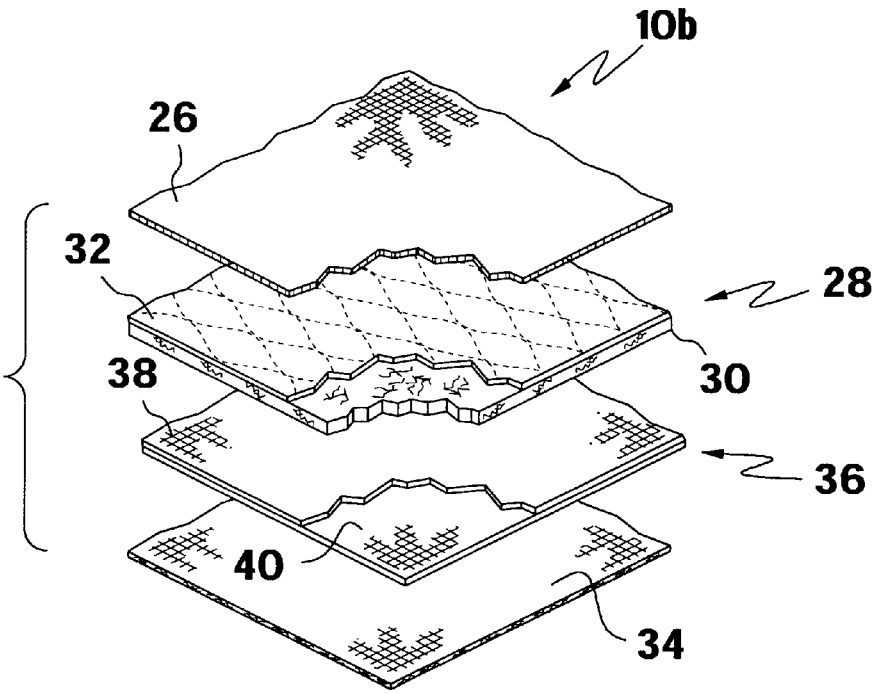
FIG. 3 is an exploded, perspective view of a detail of an alternate embodiment of the present invention.

As shown in FIG. 3, another alternate embodiment 10*b* of a firefighter garment of the present invention includes a thermal liner 28 adjacent to the outer shell 26 as with the embodiment of FIGS. 1 and 2, but includes a discrete moisture barrier layer 36 between the thermal liner 28 and the face cloth layer 34. As with the embodiment of FIGS. 1 and 2, the outer shell 26, thermal liner 28, and preferably the face cloth layer 34 are treated with a durable, water-repellant finish. The moisture barrier layer 36 includes a substantially liquid-impermeable membrane layer 38, which is moisture vapor permeable but impermeable to liquid moisture, such as CROSSTECH or GORE-TEX, bonded to a substrate 40 of flame- and heat-resistant material, such as an aramid or PBI material. The membrane layer 38 is typically bonded to the substrate 40 by coating the membrane material onto the substrate. It is also within the scope of the invention to use other substantially liquid-impermeable membrane materials such as neoprene. By providing such a moisture barrier 36, the penetration of blood-borne pathogens from the environment to the wearer is minimized. Furthermore, the positioning of the thermal liner 28 between the outer shell 26 and the moisture barrier 36 protects the membrane material of the moisture barrier from damage from excessive thermal heat and from abrasion caused by the outer shell. With the embodiment of FIG. 3, the addition of a discrete moisture barrier 36 (as opposed to the water-repellent thermal liner 28 acting also as a moisture barrier for the ensemble) to the ensemble of the outer shell 26, thermal liner and face cloth layer 34, the entire ensemble 10*b* meets the N.F.P.A. 1971 Standard. Not only does the garment 10*b* resist burning, melting or dripping when exposed to 500° F. for at least five minutes, as does the garment 10 of FIGS. 1 and 2, but the garment passes the liquid penetration test (ASTM test F1359), as well as all other tests comprising the Standard. The treatments applied to the components of the garment 10*b* of FIG. 3 are also sufficiently durable to withstand at least 5 launderings, and preferably at least 25 launderings.

Figure 4:
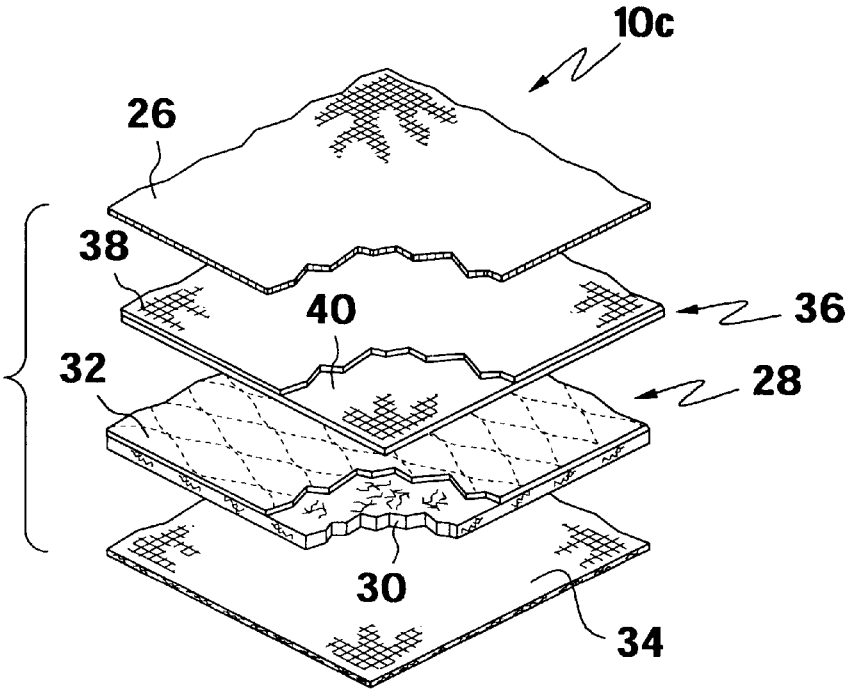
FIG. 4 is an exploded, perspective view of a detail of another alternate embodiment of the invention.

As shown in FIG. 4, in another alternate embodiment 10*c* of the garment of the present invention, the moisture barrier 36 is positioned adjacent to the outer shell 26, and the thermal liner 28 is positioned in between the moisture barrier and the face cloth layer 34. With this embodiment, the moisture barrier 36 protects the durable, moisture-resistant thermal liner 28 from liquid moisture penetrating the outer shell 26. The advantage of utilizing the moisture resistant thermal liner 28 of the present invention in this embodiment is that the moisture resistance of the thermal liner minimizes its absorption of liquid perspiration from a wearer, as well as absorption of liquid moisture from wicking from sleeve and neck openings or from a small tear in the moisture barrier.

Furthermore, the garment 10*c* of FIG. 4 meets the N.F.P.A. 1971 Standard. In particular, the garment 10*c* resists igniting, melting or dripping when exposed to 500° F. for at least five minutes, passes the liquid penetration test, and passes all other tests comprising the Standard. While in the preferred form of the embodiment of the garment 10*c* the outer shell 26, thermal liner 28 and face cloth layer 34 are each treated to have the durable, water-repellent finish described with respect to the garment 10*a*, the garment 10*c* can be modified such that either the face cloth layer 32 or face cloth layer 34 is not treated with the water-repellant finish.

Figure 5:
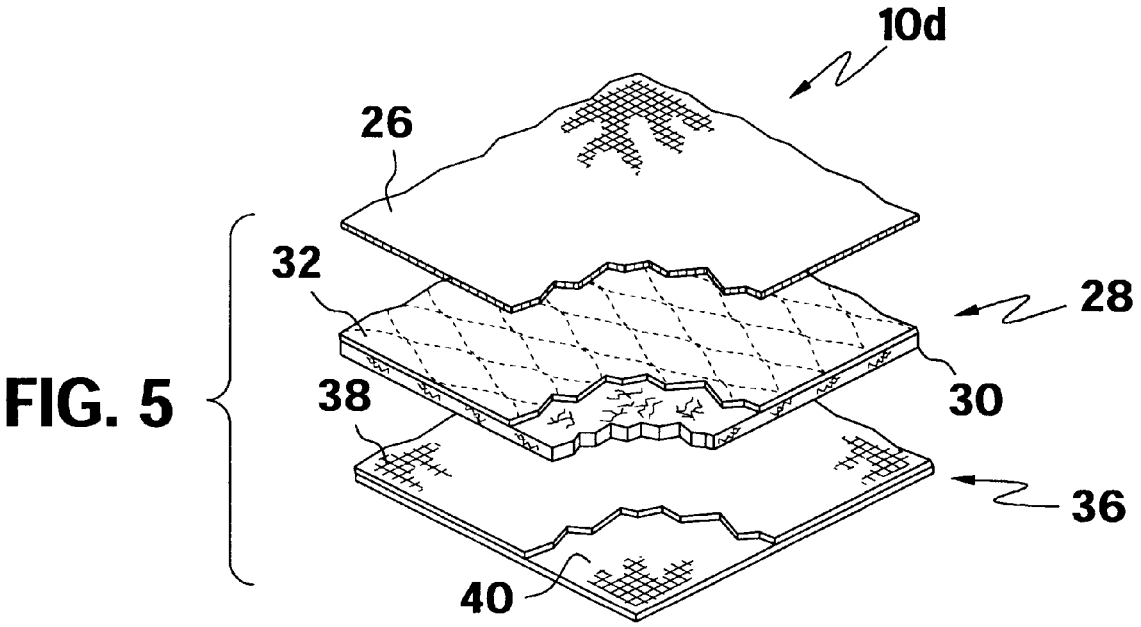
FIG. 5 is an exploded, perspective view of a detail of a first preferred embodiment of the invention.

As shown in FIG. 5, a preferred embodiment of the invention 10*d* includes a thermal liner 28 positioned adjacent to the outer shell 26, and includes a discrete moisture barrier layer 36 positioned as the inner-most layer of the garment. The outer shell 26 and the layer of insulating material 30 of the thermal liner are both treated with a durable, water-repellant finish as described above. It is also preferred that the fabric substrate 32 of the thermal liner be treated with the durable, water-repellant finish. The moisture barrier layer 36 includes a substantially liquid-impermeable membrane layer 38 bonded to a substrate 40 of flame- and heat-resistant material, such as an aramid or PBI material. By providing such a moisture barrier 36, the penetration of blood-borne pathogens from the environment to the wearer is minimized. Furthermore, the positioning of the thermal liner 28 between the outer shell 26 and the moisture barrier 36 protects the membrane material of the moisture barrier from damage from excessive thermal heat and from abrasion caused by the outer shell. The thermal liner 28 is oriented such that the fabric substrate 32 faces the outer shell 26. Therefore, the fabric substrate 32 of the thermal liner 28 protects the insulating material 30 of the thermal liner from damage and abrasion caused by contact with the outer shell 26. The moisture barrier 36 is oriented such that the fabric substrate 40 faces the wearer. Therefore, the fabric substrate 40 of the moisture barrier 36 acts as a face cloth, eliminating the need for the additional face cloth of FIG. 3.

With the embodiment of FIG. 5, the addition of a discrete moisture barrier 36 (as opposed to the water-repellent thermal liner 28 acting also as a moisture barrier for the ensemble) to the ensemble of the outer shell 26 and thermal liner 28, the entire ensemble 10*d* meets the N.F.P.A. 1971 Standard. Not only does the garment 10*d* resist burning, melting or dripping when exposed to 500° F. for at least five minutes, but the garment passes the liquid penetration test (ASTM test F1359), as well as all other tests comprising the Standard. The treatments applied to the components of the garment 10*d* of FIG. 5 are also sufficiently durable to withstand at least 5 launderings, and preferably at least 25 launderings.

Figure 6:
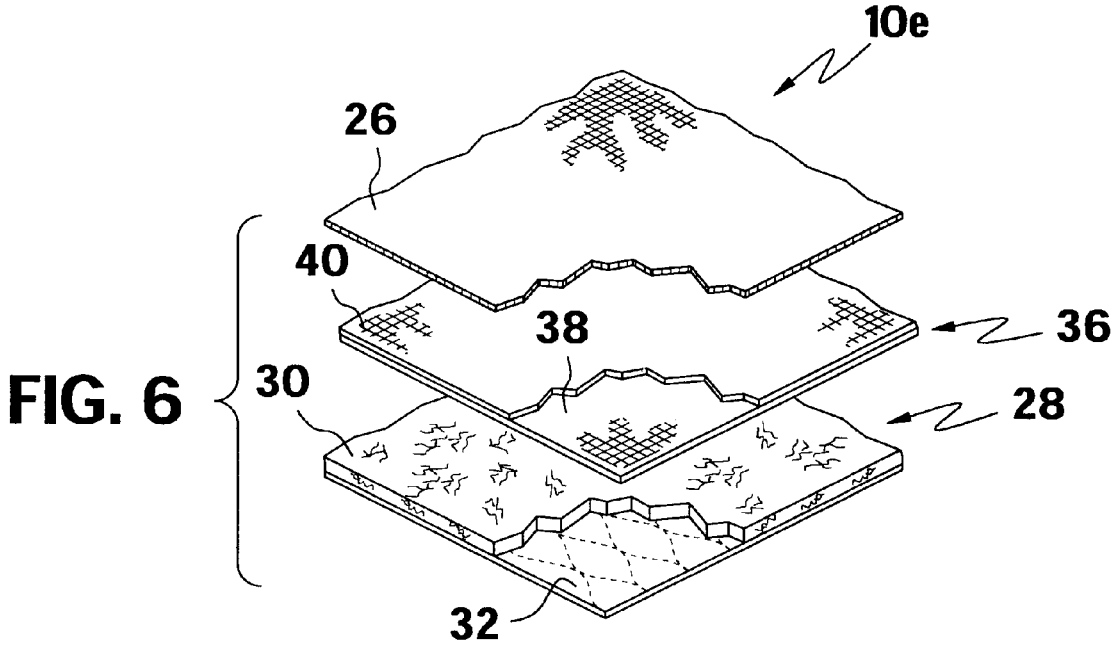
FIG. 6 is an exploded, perspective view of a detail of a second preferred embodiment of the invention.

As shown in FIG. 6, in a second preferred embodiment 10*e* of the present invention, the moisture barrier 36 is positioned adjacent to the outer shell 26, and the thermal liner 28 is positioned as the inner-most layer of the garment 10*e*. The moisture barrier 36 is oriented such that the fabric substrate 40 faces the outer shell, thus protecting the membrane layer 38 from damage caused by contact with the outer shell; and the thermal liner 28 is oriented such that the fabric substrate 32 faces the wearer of the garment, thus acting as a face cloth, and eliminating the need for the additional face cloth of FIG. 4. The outer shell 26 and insulating material 30 of the thermal liner are treated with a durable, water-repellant finish as described above. Optionally, the fabric substrate 32 of the thermal liner may also be treated with a durable, water-repellant finish. With this embodiment, the moisture barrier 36 protects the thermal liner 28 from liquid moisture penetrating the outer shell 26. The advantage of utilizing the moisture resistant thermal liner 28 of the present invention with this embodiment is that the moisture resistance of the thermal liner minimizes its absorption of liquid perspiration from a wearer, as well as absorption of liquid moisture from wicking from sleeve and neck openings or from a small tear in the moisture barrier.

Furthermore, the garment 10*e* of FIG. 6 meets the N.F.P.A. 1971 Standard. In particular, the garment 10*e* resists igniting, melting or dripping when exposed to 500° F. for at least five minutes, passes the liquid penetration test, and passes all other tests comprising the Standard.

The preferred method of constructing the garment of the present invention is as follows. A relatively lightweight, low volume protective garment is constructed by providing an outer shell of abrasion, flame and heat resistant material; treating a layer of flame and heat resistant, insulating material with a durable, water-repellant finish; attaching a fabric substrate to one side of the insulating layer so as to provide a thermal liner; and assembling the garment by positioning the thermal liner on the inner side of the outer shell. The means for cutting and attaching the various layers together to form the garment will be apparent to those skilled in the art. The method may also include the step treating the fabric substrate with a durable, water-repellant finish and/or treating the outer shell with a durable, water-repellant finish.

In one embodiment, the method includes the step of positioning a moisture barrier between the outer shell and the thermal liner; and may also include the step of attaching the fabric substrate of the thermal liner to the inner side of the insulating layer. In another embodiment, the method includes the step of positioning a moisture barrier on the inner side of the thermal liner; and may also include the step of orienting the moisture barrier so that its fabric substrate is the inner-most layer of the garment.

While the forms of apparatus herein described constitute preferred embodiments of this invention, it is to be understood that the invention is not limited to these precise forms of apparatus, and that changes may be made therein without departing from the scope of the invention. Additionally, it is to be understood that the methods described herein are not to be limited to be performed in the exact order described. Therefore, it is within the scope of the invention to change the order of any of the disclosed steps or to add additional steps.

What is claimed is:

1. A protective garment comprising:

an outer shell treated with a durable, water-repellant finish;

a layer of insulating material attached to a first fabric substrate so as to provide a thermal liner, the thermal liner being positioned between the outer shell and a wearer of the garment, the layer of insulating material being treated with a durable, water-repellant finish;

a substantially liquid-impermeable membrane bonded to a second fabric substrate so as to provide a moisture barrier layer, the moisture barrier layer being positioned between the outer shell and a wearer of the garment.

2. The protective garment of claim 1, wherein the first fabric substrate is treated with a durable, water-repellant finish.

3. The protective garment of claim 1, wherein the moisture barrier layer is positioned between the thermal liner and the outer shell.

4. The protective garment of claim 3, wherein the moisture barrier layer is oriented such that the second fabric substrate faces the outer shell.

5. The protective garment of claim 4, wherein the thermal liner is oriented such that the first fabric substrate faces a wearer of the garment.

6. The protective garment of claim 5, wherein the first fabric substrate is treated with a durable, water-repellant finish.

7. The protective garment of claim 1, wherein the thermal liner is positioned between the moisture barrier layer and the outer shell.

8. The protective garment of claim 7, wherein the thermal liner is oriented such that the first fabric substrate faces the outer shell.

9. The protective garment of claim 8, wherein the moisture barrier layer is oriented such that the second fabric substrate faces a wearer of the garment.

10. The protective garment of claim 9, wherein the first fabric substrate is treated with a durable, water-repellant finish.

11. A firefighting garment comprising:

an outer shell of abrasion, flame and heat resistant material;

a discrete moisture barrier positioned between the outer shell and a wearer of the garment; and a thermal liner positioned between the outer shell and a wearer of the garment, the thermal liner including a layer of insulating material and a first fabric substrate material attached to the layer of insulating material;

the layer of insulating material being selected from a group consisting of an aramid needlepunch material, an aramid batting material, an aramid nonwoven material, an aramid-blend needlepunch material, an aramid-blend batting material and an aramid-blend nonwoven material;

the first fabric substrate being taken from a group consisting of an aramid material, a polybenzamidazole material, a blend of aramid materials, and a blend of aramid and polybenzamidazole materials; and the material of the outer shell and the layer of insulating material being treated with a durable, water-repellant finish.

12. The firefighting garment of claim 11, wherein the finish includes a perflourohydrocarbon finish.

13. The firefighting garment of claim 11, wherein:

the moisture barrier is positioned between the outer shell and the thermal liner; and the thermal liner is oriented such that the first fabric substrate faces a wearer of the garment.

14. The firefighting garment of claim 13, wherein:

the moisture barrier includes a substantially liquid-impermeable membrane layer bonded to a second fabric substrate; and the moisture barrier is oriented such that the second fabric substrate faces the outer shell.

15. The firefighting garment of claim 11, wherein:

the thermal liner is positioned between the outer shell and the moisture barrier; and the thermal liner is oriented such that the first fabric substrate faces the outer shell.

16. The firefighting garment of claim 15, wherein:

the moisture barrier includes a substantially liquid-impermeable membrane layer bonded to a second fabric substrate; and the moisture barrier is oriented such that the second fabric substrate faces a wearer of the garment.

17. A method of constructing a relatively lightweight, low volume protective garment comprising the steps of:

providing an outer shell of abrasion, flame and heat resistant material;

treating a layer of flame and heat resistant, insulating material with a durable, water-repellant finish, the insulating layer having an inner side and an outer side;

attaching a first fabric substrate to one of the inner side and outer side of the insulating layer so as to provide a thermal liner having an inner side and an outer side; and assembling the garment by positioning the thermal liner on the inner side of the outer shell.

18. The method of claim 17, further comprising the step of treating the first fabric substrate with a durable, water-repellant finish.

19. The method of claim 17 wherein the assembling step includes the step of positioning a moisture barrier between the inner side of the outer shell and the outer side of the thermal liner.

20. The method of claim 19, wherein the attaching step includes the step of attaching the first fabric substrate to the inner side of the insulating layer.

21. The method of claim 17, wherein the assembling step includes the step of positioning the moisture barrier on the inner side of the thermal liner.

22. The method of claim 21, wherein the moisture barrier includes a substantially liquid-impermeable membrane layer attached to a second fabric substrate, and wherein the assembling step includes the step of orienting the moisture barrier so that the second fabric substrate is the inner-most layer of the garment.

23. The method of claim 22, further comprising the step of treating the first fabric substrate with a durable, water-repellant finish.

24. The method of claim 17, wherein the step of treating the insulating layer with a durable, water-repellant finish includes the step of treating the insulating layer with a perflourohydrocarbon finish.

25. The method of claim 17, further comprising the step of treating the outer shell with a durable, water-repellant finish.

* * * * *